US005469952A

United States Patent [19]

Kershaw et al.

[11] Patent Number: 5,469,952

[45] Date of Patent: Nov. 28, 1995

[54] COIN DISCRIMINATION APPARATUS

[75] Inventors: John Kershaw, Oldham; Lesley Hutton, Rochdale, both of England

[73] Assignee: Coin Controls Limited, Lancashire, England

[21] Appl. No.: 211,154

[22] PCT Filed: Apr. 30, 1992

[86] PCT No.: PCT/GB92/00791

§ 371 Date: Apr. 28, 1994

§ 102(e) Date: Apr. 28, 1994

[87] PCT Pub. No.: WO93/06569

PCT Pub. Date: Apr. 1, 1993

[30] Foreign Application Priority Data

Sep. 24, 1991 [GB] United Kingdom ..... 9120315

[51] Int. Cl.[6] ..... G07D 5/04; G07D 5/08

[52] U.S. Cl. ..... 194/317; 194/339

[58] Field of Search ..... 194/317, 339

[56] References Cited

U.S. PATENT DOCUMENTS

| | | | |
|---|---|---|---|
| 4,538,719 | 9/1985 | Gray et al. . | |
| 4,601,380 | 7/1986 | Dean et al. | 194/318 |
| 4,686,385 | 8/1987 | Sharpe | 307/261 |
| 4,754,862 | 7/1988 | Rawicz-Szcerbo et al. | 194/319 |
| 4,951,800 | 8/1990 | Yoshihara et al. | 194/317 |
| 5,007,520 | 4/1991 | Harris et al. | 194/317 |
| 5,062,518 | 11/1991 | Chitty et al. | 194/317 |
| 5,085,309 | 2/1992 | Adamson et al. | 194/317 |
| 5,158,166 | 10/1992 | Barson | 194/319 |
| 5,180,046 | 1/1993 | Hutton et al. | 194/319 |
| 5,226,520 | 7/1993 | Parker | 194/317 |

FOREIGN PATENT DOCUMENTS

| | | | |
|---|---|---|---|
| 0164110 | 12/1985 | European Pat. Off. . | |
| 0404432 | 12/1990 | European Pat. Off. . | |
| 2169429 | 9/1987 | United Kingdom . | |
| 2200778 | 8/1988 | United Kingdom | 194/317 |

*Primary Examiner*—F. J. Bartuska
*Attorney, Agent, or Firm*—Morgan & Finnegan

[57] ABSTRACT

Coin discrimination apparatus includes a coin rundown path along which coins roll so as to impact a snubber provided with a piezo electric device. The coin impact produces an oscillatory voltage output from the device, which is sampled over a predetermined period for its peak maximum and minimum values. The values are combined in a predetermined relationship to produce a coin parameter signal indicative of coin mass and the material from which it is made. Coin acceptability is determined on the basis of the value of the coin parameter signal.

13 Claims, 3 Drawing Sheets

COIN DISCRIMINATION APPARATUS

FIELD OF THE INVENTION

This invention relates to coin discrimination apparatus which has particular but not exclusive application to a multi-coin validator.

BACKGROUND OF THE INVENTION

In a conventional multi-coin validator, coins pass along a path past a number of spaced sensor coils which are each energised to produce an inductive coupling of the coin. The degree of interaction between the coil and the coin is a function of the relative size of the coin and coil, the material from which the coin is made and also its surface characteristics. Thus, by monitoring the change in impedance presented by each coil, data indicative of the coin under test can be provided. The data can be compared with information stored in the memory to determine coin denomination and authenticity. An example of such an inductive validator is disclosed in UK Patent Specification 2 169 429 (Coin Controls Limited).

It has also been proposed in the past to use optical detectors to discriminate between coins on the basis of their optical characteristics e.g. diameter.

However, it has been found that certain types of counterfeit coins such as lead discs or discs made from a lead alloy cannot readily be distinguished by conventional validators from true coins since the characteristics of the counterfeits are too similar to acceptable coins to permit effective discrimination.

Coin validators incorporating piezo electric elements for sensing the impact of the coin falling onto part of the coin path are known from International Patent Application No. PCT/DK82/00072 (GNT Automatic A/S) and GB-A-2 236 609 (Mars Incorporated).

In PCT/DK82/00072, the mechanical elasticity of the coin is determined by causing the coin to apply an impact force to a piezo electric element, the output of which is amplified and compared with a preset threshhold amplitude value to determine coin acceptability. A coin made of lead or lead alloy produces a lower output of the piezo electric device than a corresponding true coin and thus by appropriately setting the threshhold value, discrimination between true and counterfeit coins can be achieved.

GB-A-2 236 609 discloses a similar arrangement in which the signal from the piezo electric element is differentiated prior to comparison with a predetermined threshhold in order to reduce the effects of variation in coin impact velocity.

It is an object of the present invention to provide an improved coin discrimination apparatus utilising an impact responsive sensor.

SUMMARY OF THE INVENTION

In accordance with the invention, there is provided coin discrimination apparatus comprising: means defining a path for coins under test; a surface to be impacted by coins that pass along the path; sensor means for providing an electrical output signal in response to impact of a coin with the surface; means for detecting the peak maximum and minimum of said output signal within a given duration following impact; and means for determining coin acceptability in dependence upon said detected maximum and minimum of the output signal.

In accordance with the invention, it has been appreciated that when a coin impacts against the surface, the sensor means provides an osillatory signal wherein the amplitude between the peak maximum and minimum occurring over a given duration following impact, is a function of the ringing or damping, which, in turn, is dependent upon the mechanical characteristics of the material from which the coin under test is made. Thus, if the coin is formed of lead or a lead alloy, the output signal is damped in comparison to that produced by a true coin, with the result that the difference between the peak maximum and minimum is reduced. Thus, the relationship between the maximum and minimum varies as a function of the material from which the coin is made, and can be used to determine coin acceptability.

The aforesaid maximum of the output signal is a function of the impact force of the coin, which in turn is dependent upon coin mass. In accordance with the invention, a coin parameter signal may be formed from a combination of the maximum and minimum values. Preferably, the value of the maximum signal is scaled by a given factor relative to the minimum whereby the parameter signal is a function of both the mechanical elasticity of the coin material and the coin mass.

BRIEF DESCRIPTION OF THE DRAWINGS

In order that the invention may be more fully understood an embodiment thereof will now be described by way of example with reference to the accompanying drawings in which.

DESCRIPTION OF EMBODIMENT

Figure 1:
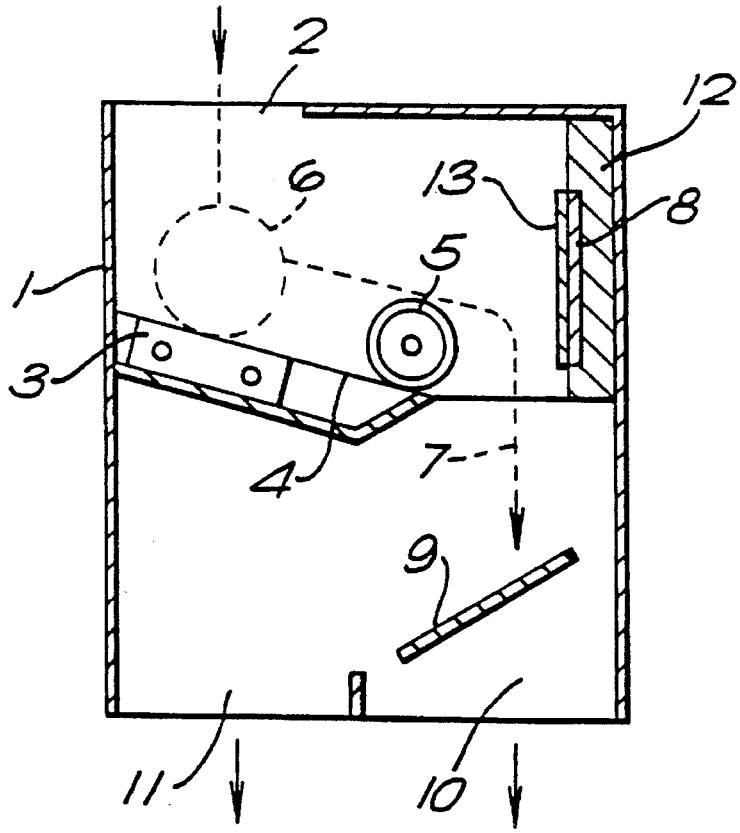
FIG. 1 is a schematic side elevational view of a coin discrimination apparatus according to the invention.

Referring to FIG. 1, the apparatus consists of a body 1 including a coin inlet 2 into which coins are inserted from above, so as to fall onto an anvil 3 and then roll edgewise along a coin rundown path 4 past an inductive sensing station 5. A coin 6 is shown in dotted outline, which travels along path 7, also shown in dotted outline.

When the coin 6 falls onto the anvil 3, its velocity in the horizontal direction (as shown in FIG. 1) is substantially zero. The coin then rolls edgewise along the path 4 through the sensing station 5 and impacts a snubber 8, turns through approximately 90° and falls towards a solenoid operated accept gate 9. Circuitry to be described in more detail hereinafter opens gate 9 to allow an acceptable coin to pass into an accept chute 10 whereas for non-acceptable coins, the gate remains closed so that they pass to a reject chute 11.

Referring to the snubber 8 in more detail, it consists of a metal plate 12 on which a piezo electric element 13 is mounted. The element 13 produces an oscillatory voltage in response to coin impact, the nature of the oscillatory voltage being dependent upon the impact force and the material from which the coin is made.

The inductive sensing station 5 includes one or more inductor coils which form an eddy current type inductive coupling with a coin under test. The manner of operation of the inductor coils may be as described in more detail in specification GB-A-2 169 429.

Figure 2:
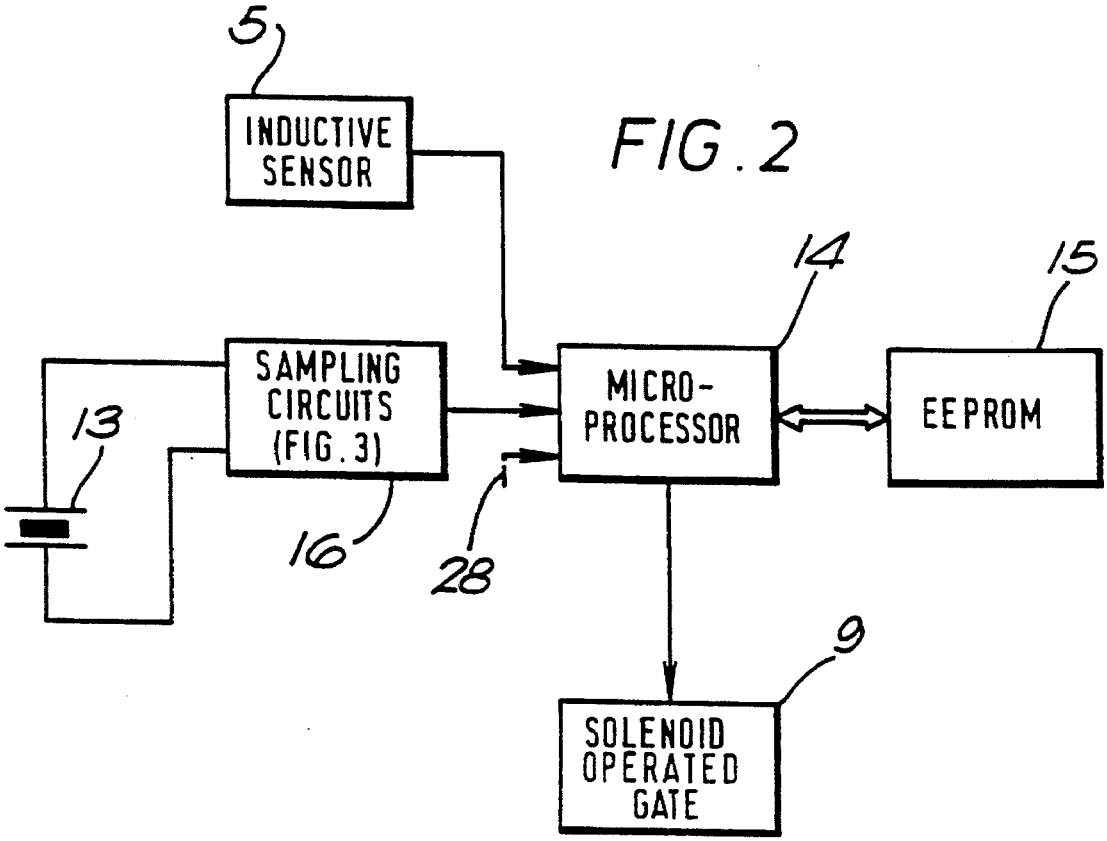
FIG. 2 is a block diagram of electrical discrimination circuitry associated with the apparatus shown in FIG. 1.

Referring to FIG. 2, outputs from the inductive sensor 5 and the piezo electric device 13 are fed to a microprocessor 14 and compared with preprogramed values representative of acceptable coins held in an EEPROM 15. If the coin under test is found to be of acceptable demonination, the microprocessor causes the solenoid accept gate 9 to open so as to permit the coin to pass into the accept chute 10.

Figure 3:
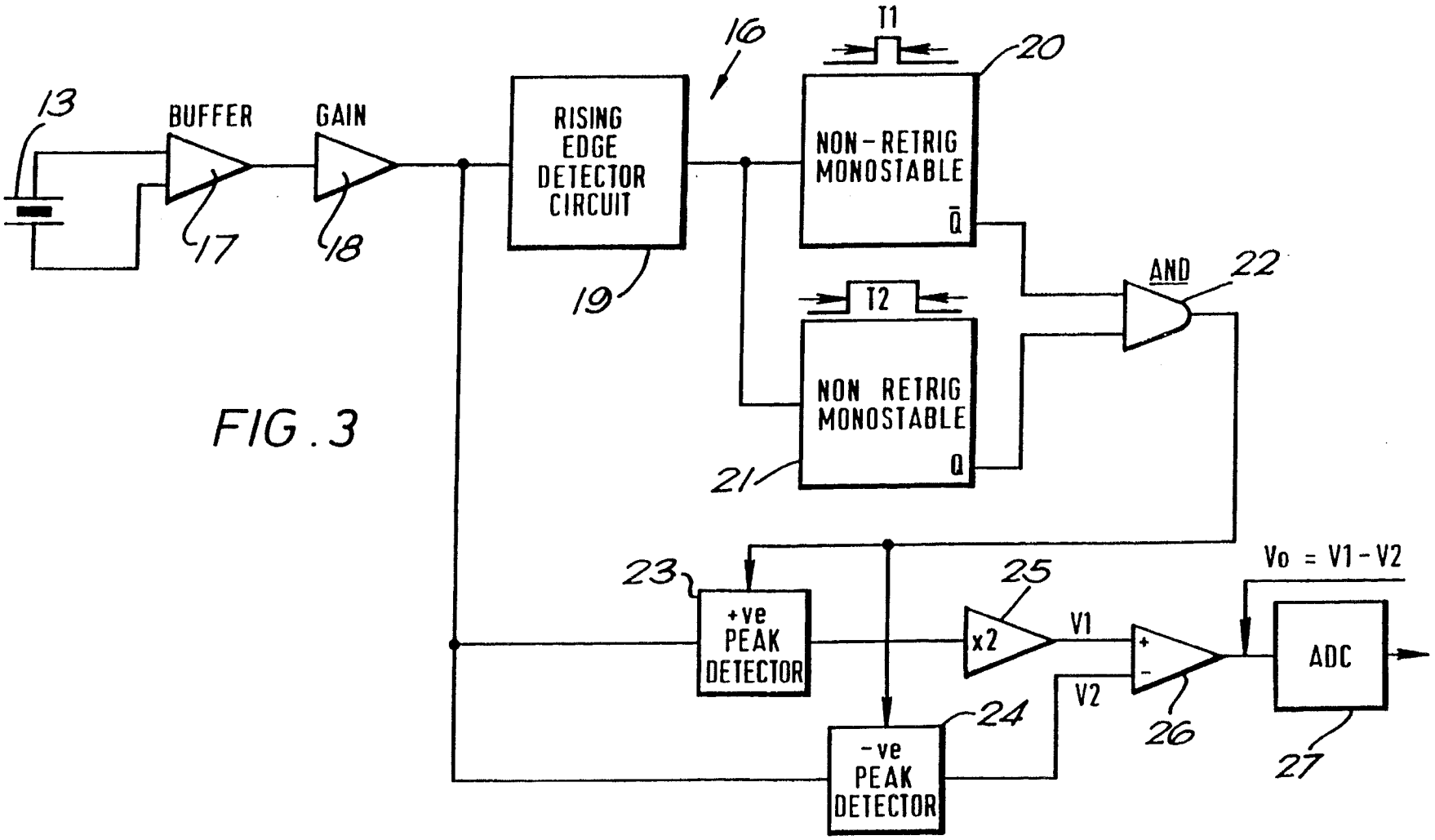
FIG. 3 is a more detailed block diagram of sampling circuits shown in FIG. 2.

The output of the piezo electric element 13 is fed through sampling circuits 16 which are shown in more detail in FIG. 3.

Figure 4:
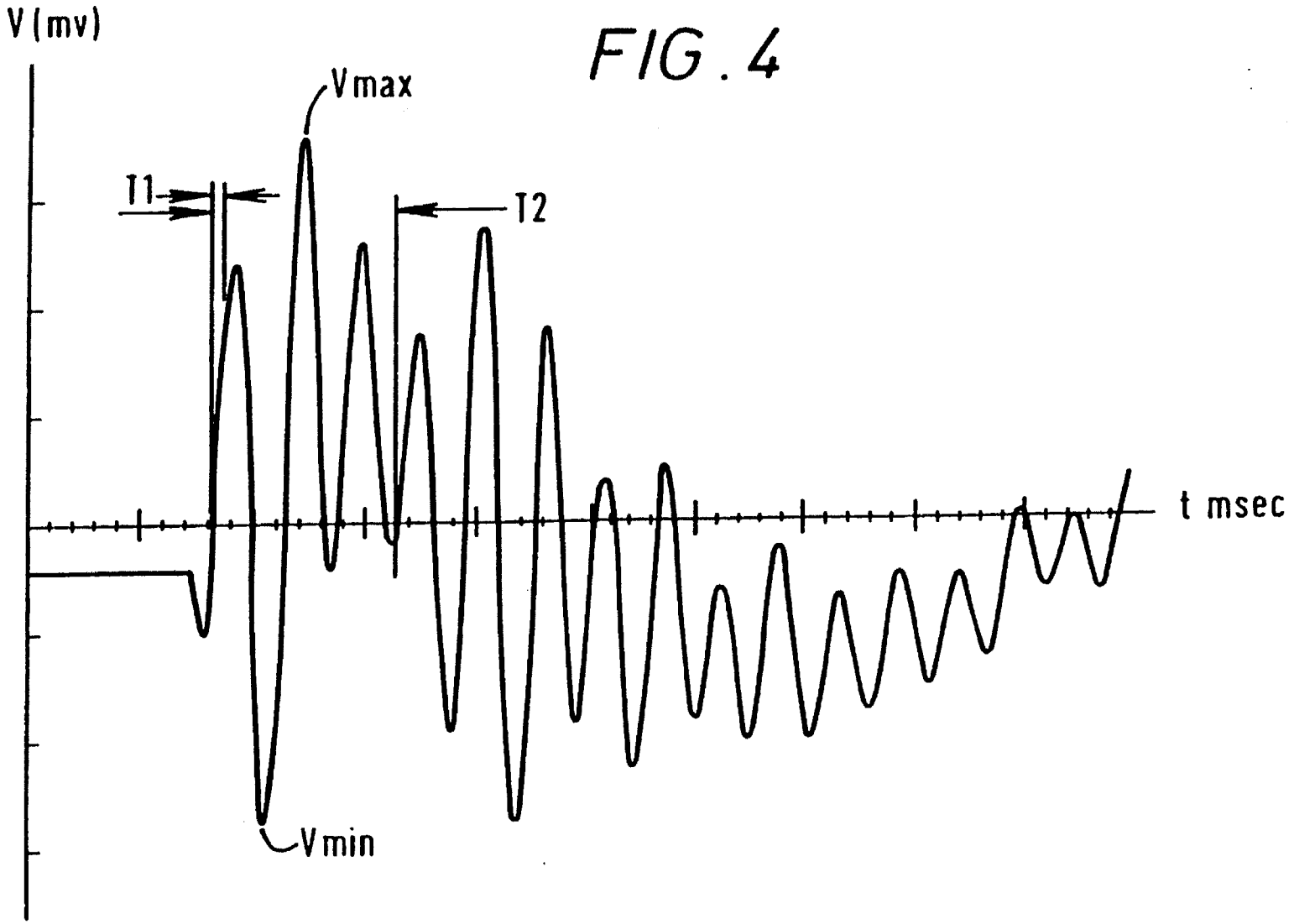
FIG. 4 illustrates the wave form produced by impact of the piezo electric element shown in FIGS. 1 to 3.

In order to understand the principles of operation of the circuit shown in FIG. 3, reference will firstly be made to FIG. 4 which shows the wave form produced by the piezo electric element 13 upon impact by a coin 6 under test. The voltage initially rises in response to the coin impact and thereafter decays in an oscillatory manner. The circuit of FIG. 3 is configured to analyse the decay of the piezo electric ouptut voltage. Thus, after an initial rise time T1, a time window of a predetermined duration T2 is defined during which the output signal is analysed. In accordance with the invention, it has been appreciated that the difference between the peak maximum and the peak minimum values of the signal during the period T2 is a function of the "ringing" produced by impact of the coin. Thus, if the coin under test is made of lead or lead alloy, which is a relatively compliant material in comparison with the alloy of the true coin, the response as shown in FIG. 4 is damped in comparison with the corresponding response produced by a true coin, since the material of the true coin exhibits a greater mechanical elasticity and hence a greater "ringing" effect. Also, the peak amplitude occurring during the time window is a function of the impact force which, in turn is a function of coin mass. [This assumes that all coins under test have the same initial velocity at the start of the coin rundown 4 (FIG. 1) and are subjected to the same conditions of acceleration.] It will be appreciated that the mass of a lead or lead alloy counterfeit may differ from that of a corresponding true coin. The foregoing can be expressed as follows:

$$m_c \alpha Vmax \quad \text{(I)}$$

$$e_c \alpha (Vmax - Vmin) \quad \text{(II)}$$

where

Vmax=peak maximum voltage during T2

Vmin=peak maximum voltage during T2

$e_c$=coin material elasticity $m_c$=coin mass

The circuit of FIG. 3 is configured to produce a parameter signal P which is a function of both coin elasticity and coin mass. The parameter signal P can be expressed as follows:

$$P = m_c + e_c \quad \text{(III)}$$

From equations (I) and (II) it can be seen that the parameter signal can be expressed as:

$$P \alpha Vmax + (Vmax - Vmin)$$

$$P \alpha 2Vmax - Vmin \quad \text{(IV)}$$

It has been found that the parameter signal P as expressed in equation (IV) distinctively characterises the coin under test. Thus, the circuit of FIG. 3 is configured to compute the parameter signal P so that it can be compared with preprogrammed values in the EEPROM 15 (FIG. 2) by means of the microporcessor 14.

Referring to FIG. 3 in more detail, the output from the piezo electric element 13 is applied through a buffer amplifier 17 and a high gain amplifier 18 to a rising edge detector circuit 19 which produces a trigger pulse in response to a rising edge in the output signal produced by coin impact with the element 13. The output pulse from the detector circuit 19 is fed to two non-retriggerable monostables 20, 21, which define the time periods T1 and T2 respectively. The Q output of monostable 20 together with the Q output of monostable 21 are fed as inputs to AND gate 22 and as a result, the output of gate 22 constitutes an enabling signal for the time window T2, this window occurring after an initial non-enabled period T1.

The enabling signal from AND gate 22 is fed to positive and negative peak detector circuits 23, 24 so as to enable them to detect values Vmax and Vmin during the window T2. The output of detector 23 is fed to a voltage doubler amplifier 25, which produces the voltage V1: thus $$V1 = 2Vmax \quad \text{(V)}$$

The peak detector 24 produces a voltage $$V2 = Vmin \quad \text{(VI)}$$

The voltages V1 and V2 are applied as inputs to a subtracting amplifier 26 which provides an output Vo where $$Vo = V1 - V2 = P_c \quad \text{(VII)}$$

This signal $P_c$ thus constitutes a parameter signal which, as previously mentioned, distinctly characterises the coin under test and is primarily a function of the mass and mechanical elasticity of the coin. The signal $P_c$ is applied to an analogue to digital converter 27 to produce a digital number that can be fed to the micrprocessor for comparison with stored values indicative of acceptable coins held by the EEPROM 15. A determination of coin acceptability can thereby be made by the microprocessor 14 in dependence upon the output of the inductive sensor and the piezo electric element 13. Referring to FIG. 2, it will be appreciated that an optical sensor could be used in addition to the inductive sensor 5 or as an alternative thereto in order to provide additional validation inputs as shown schematically as input 28. Also, the output of the sampling circuit 16 may be ignored for certain validation processes selectively in accordance with preprogrammed routines in the microprocessor 14.

The described arrangement is particularly effective for discriminating between true coins and slugs made of lead or lead alloy which exhibit very similar electrical and dimensional characteristics to true coins. Many modifications and variations will be apparent to those skilled in the art. For example, instead of providing a single parameter signal P, it will be possible to store individual reference values for the signals V1 and V2 in the EEPROM 15 and compare them individually with values derived from a coin under test. However, the described arrangement has the advantage that a single reference parameter P can be stored in the EEPROM. As a practical matter, for each reference value P, a window range will be stored in order to accommodate a range of acceptable values normally associated with a distribution of acceptable coins of a particular denomination.

As used herein the term coin is intended to include a token or like item of credit.

We claim:

1. Coin discrimination apparatus comprising:

means defining a path for coin under test;

a surface to be impacted by coins that pass along path;

sensor means for providing an electrical output signal in response to impact of a coin with the surface;

means for defining a predetermined duration following impact of the coin with the sensor means;

maximum peak detecting means for detecting the peak maximum amplitude of the output signal that occurs within said predetermined duration following impact;

minimum peak detecting means for detecting the peak minimum amplitude of the output signal that occurs within said predetermined duration following impact; and means for determining coin acceptability in dependence upon the detected values of the peak maximum and minimum amplitudes.

2. Apparatus according to claim 1 including means for deriving a coin parameter signal as a given function of said detected maximum and minimum of said output signal, and means for determining coin acceptability in dependence upon said coin parameter signal.

3. Apparatus according to claim 2, including edge detection circuit means for detecting a change in said output signal resulting from coin impact with the surface, first and second peak detection means for detecting the respective peak maximum and minimum amplitudes of the output signal, and enabling means responsive to said edge detection circuit means for enabling said at least one of the peak detection circuit means for said given duration following coin impact.

4. Apparatus according to claim 3 including means for defining a first time period following said coin impact and means for defining said given duration, commencing from the end of said time period.

5. Apparatus according to claim 2 including analogue to digital converter means for producing a digital value of said coin parameter signal.

6. Apparatus according to claim 2 including means for storing reference values of the coin parameter signal, and means for comparing the coin parameter signal from a coin under test with said reference values, for determining coin acceptability.

7. Apparatus according to claim 2 wherein said coin path includes a coin inlet, a coin rundown, coin sensing means disposed adjacent the coin rundown, said surface being disposed at the end of the coin rundown so as to be impacted by a coin under test after passage past the coin sensing means.

8. Apparatus according to claim 2 wherein said coin acceptability determining means includes an inductive sensor and means for determining coin acceptability in dependence upon both said coin parameter signal and the output of the inductive sensor.

9. Apparatus according to 1 and further including an optical sensor.

10. Apparatus according to 1 wherein said sensor means comprises a piezo electric element.

11. A coin validator including coin discrimination apparatus according to claim 1.

12. Coin discrimination apparatus comprising:

means defining a path for coin under test;

a surface to be impacted by coins that pass along path;

sensor means for providing an electrical output signal in response to impact of a coin with the surface;

means for detecting the peak maximum and minimum of said output signal within given duration following impact;

means for determining coin acceptability in dependence upon said detected maximum and minimum of output signal;

means for deriving a coin parameter signal as a given function of said detected maximum and minimum of said output signal, and means for determining coin acceptability in dependence upon said coin parameter signal; wherein said coin parameter signal includes a combination of said maximum and minimum values wherein the value of said maximum is scaled by a predetermined factor relative to the value of the minimum.

13. Apparatus according to claim 12 wherein said coin parameter signal is a function of the difference between twice the maximum, and said minimum.

* * * * *